United States Patent [19]

Mortvedt

[11] Patent Number: 4,684,131

[45] Date of Patent: Aug. 4, 1987

[54] GRAPHITE COMPOSITE RACQUET WITH ARAMID CORE

[75] Inventor: Raymond L. Mortvedt, Santee, Calif.

[73] Assignee: Ektelon, San Diego, Calif.

[21] Appl. No.: 788,441

[22] Filed: Oct. 17, 1985

Related U.S. Application Data

[63] Continuation of Ser. No. 620,634, Jun. 14, 1984, abandoned.

[51] Int. Cl.[4] ..... A63B 49/10

[52] U.S. Cl. ..... 273/73 F; 273/DIG. 7; 273/DIG. 23; 273/73 D

[58] Field of Search ..... 273/73 C, 73 F, 73 H, 273/DIG. 7, DIG. 23; D21/212

[56] References Cited

U.S. PATENT DOCUMENTS

| | | | |
|---|---|---|---|
| 3,690,658 | 9/1972 | Howe | 273/73 C |
| 3,755,037 | 8/1973 | Erwin et al. | 273/DIG. 7 |
| 4,066,260 | 1/1978 | Rodgers | 273/73 H X |
| 4,070,020 | 1/1978 | Dano | 273/DIG. 23 |
| 4,070,021 | 1/1978 | Cecka et al. | 273/DIG. 27 |
| 4,177,990 | 12/1979 | Kajiwara | 273/73 F X |
| 4,221,382 | 9/1980 | Cooper et al. | 273/73 F |
| 4,357,013 | 11/1982 | Fernandez et al. | 273/73 F X |
| 4,399,992 | 8/1983 | Molitor | 273/73 F |
| 4,429,873 | 2/1984 | Raemdonck | 273/73 F |
| 4,531,738 | 7/1985 | Mortvedt et al. | 273/73 C |

FOREIGN PATENT DOCUMENTS

| | | | |
|---|---|---|---|
| 2336952 | 7/1977 | France | 273/73 H |

OTHER PUBLICATIONS

Model CM300 Racquetball Racquet; The Sporting Goods Dealer; Jul. 1977, p. 123.

Leach Racquetball Racquet; The Sporting Goods Dealer; Jan. 1978, p. 9.

Champion Racquetball Racquets; The Sporting Goods Dealer; Jul. 1977, back cover.

Ektelon Graphite CBK Racquetball Racquet; Advertisement; May 1981.

*Primary Examiner*—Richard C. Pinkham

*Assistant Examiner*—Matthew L. Schneider

*Attorney, Agent, or Firm*—Oldham, Oldham & Weber Co.

[57] ABSTRACT

The present invention comprises a graphite composite racquet frame having a particular structure that provides internal and external shock absorption. The internal shock absorption is provided by a core material having high impact strength such as an aromatic aramid. External shock absorption is provided by a fiber reinforced plastic wrapping. The shock absorption elements allow graphite fibers to be used for construction of racquets which are commonly subject to a great deal of physical abuse such as racquetball racquets.

6 Claims, 6 Drawing Figures

AA

BB

CC

50

| PATTERN | QTY. | MATERIAL TYPE |
|---|---|---|
| C-2 | 2 | GRAPHITE |
| F-2 | 2 | FIBERGLASS |
| H-1 | 1 | GRAPHITE |
| J-1 | 1 | GRAPHITE |
| J-2 | 2 | GRAPHITE |
| K-1 | 1 | KEVLAR |
| M-1 | 4 | BORON |
| N-1 | 1 | FIBERGLASS |
| L-1 | 2 | LEAD TAPE |

GRAPHITE COMPOSITE RACQUET WITH ARAMID CORE

CROSS-REFERENCE

This is a continuation application of application Ser. No. 620,634, filed June 14, 1984, and now abandoned.

TECHNICAL FIELD

The present invention herein described relates to the field of racquets, and particularly to graphite composites. These composites have been known to be durable as well as to lessen the weight of the racquet, and particularly to give greater stiffness, hence the ability to hit the ball harder with less effort.

BACKGROUND ART

In the past, racquets have been made out of wood, steel, aluminum and other metallic elements. The present invention is that of a graphite composite. Graphite has been used in the past, however, there have been problems with the rigidity of the graphite which can lead to shattering of the racquets. In a sport like racquetball, due to the abusive nature of the sport, there is a need for an improvement in the graphite composites to make the racquets more durable. This need is met by the present invention, which provides a unique cushioning of the graphite core.

DISCLOSURE OF INVENTION

It is an aspect of the present invention to have composite layers of boron, aramid, lead, and graphite.

It is another aspect of the present invention to increase the strength of the racquet.

Still another aspect of the present invention is to increase the racquet's overall durability.

Yet another aspect of the present invention is to keep the racquet light and maneuverable.

Still another aspect of the present invention is that of fewer longitudinal and transversal strings.

Yet another aspect of the present invention is the sunburst design of the strings, and the throatless "wishbone" shaped frame.

These aspects and other aspects of the invention will become more apparent upon a reading of the preferred embodiments, which are achieved by: a graphite composite racquet frame, comprising a core of aramid; layers of boron and graphite fibers surrounding said core; and a fiber glass wrapping positioned over said layer of boron and graphite fiber, forming a composite thereby; wherein the graphite fiber is cushioned by the aramid on the inside and the fiber glass wrap on the outside of the racquet frame.

BEST MODE FOR CARRYING OUT THE INVENTION

Figure 1:
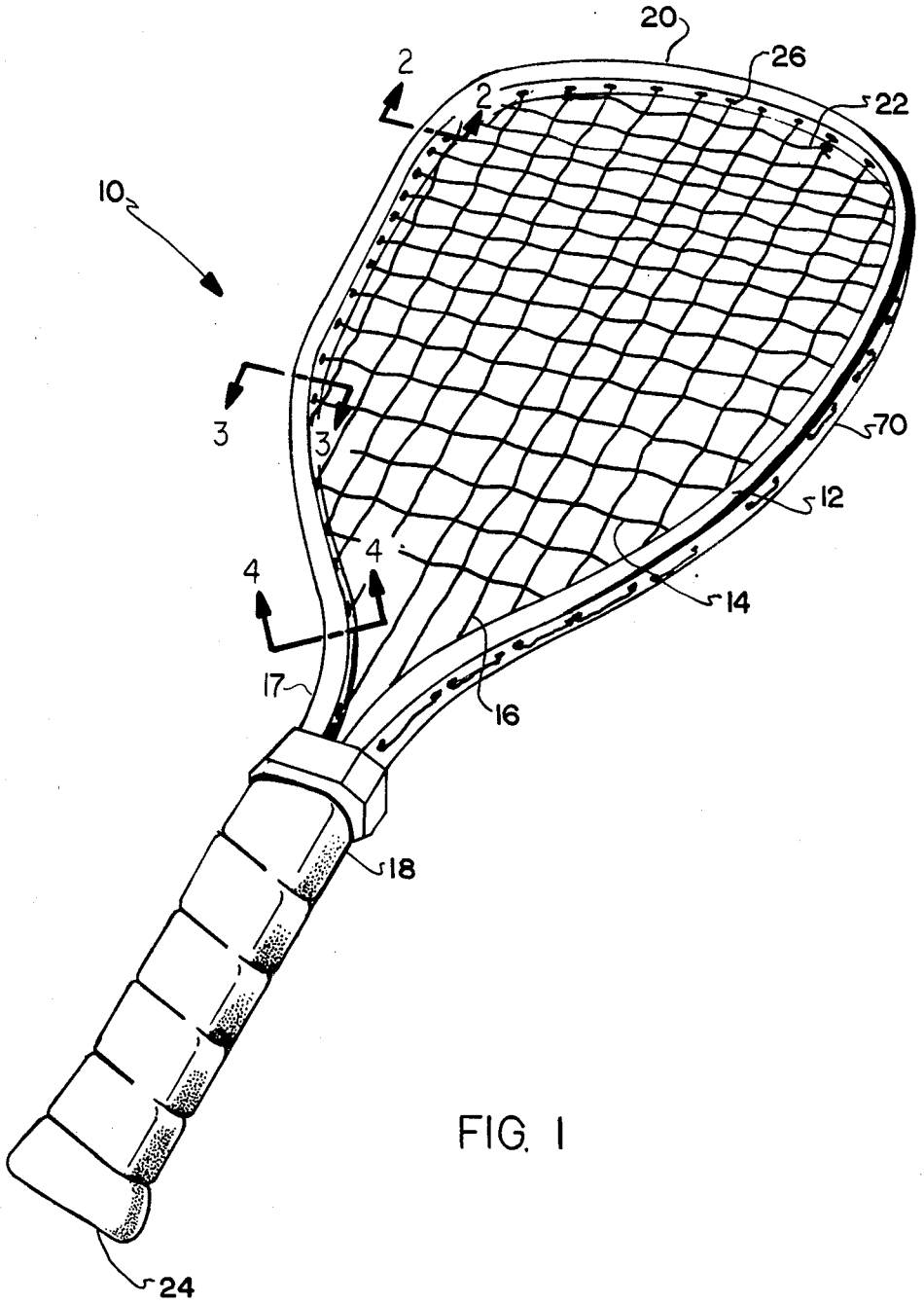
FIG. 1 is a perspective view of the racquetball racquet.

FIG. 1 is an illustration of the racquet 10. The racquet 10 is generally identified by a frame 12, a handle 18, longitudinal strings 16, and transverse strings 14. The frame 12 has a plurality of holes 26 throughout its perimeter. These holes 26 are positioned in such a way that there are 9 to 14, preferably 10 to 13, longitudinal strings 16; and, 13 to 19, preferably 15 to 18, transverse strings. This spacing of the holes 26 leads to the sunburst design of the strings. The top transverse string 22 is placed across the top eight center holes 26. This top string 22 reduces the stress on the longitudinal strings 16, thus increasing their life expectancy from breakage. Hence, the concept of the shortened top string is very important.

Figure 2:
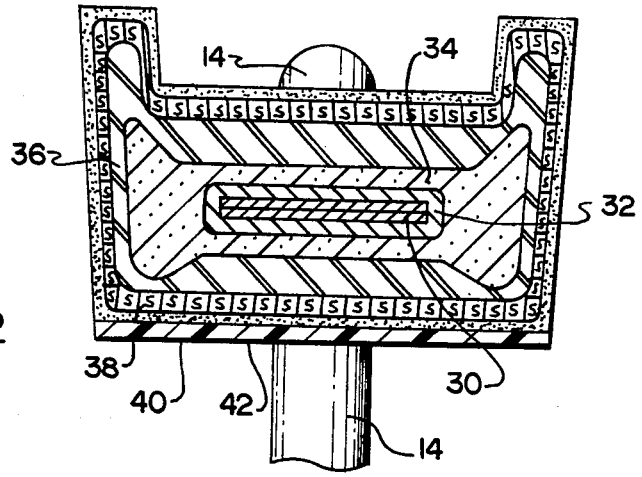
FIG. 2 is a cross-sectional view of the racquetball racquet frame at 2—2.
Figure 3:
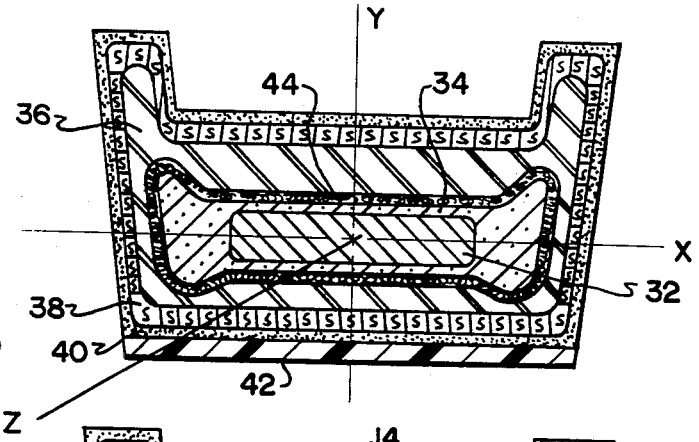
FIG. 3 is a cross-sectional view of the racquetball racquet frame at 3—3.
Figure 4:
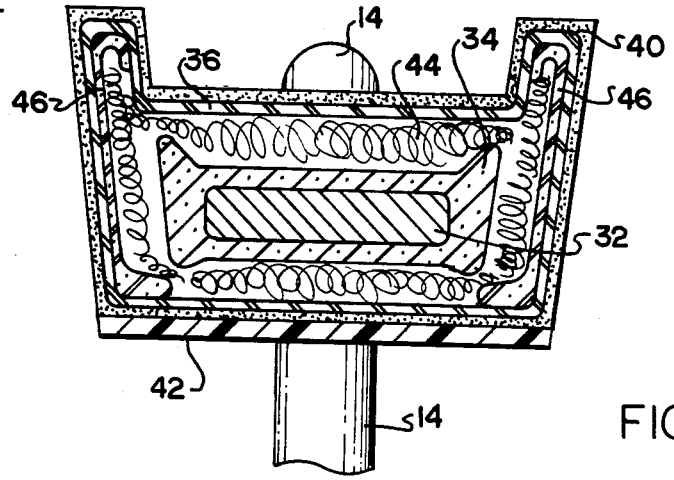
FIG. 4 is a cross-sectional view of the racquetball racquet at 4—4.

The internal construction of the racquet frame 12 is illustrated to vary depending upon where a cut is taken in the frame, and hence to best illustrate the various lay-up arrangements, cuts are taken represented by FIGS. 2, 3 and 4 at the places indicated on the basic perspective of FIG. 1.

The cross-sectional construction of the frame at the cut of FIG. 2, this being at the side portions at the top of the frame shows an internal lead layer 30 at the center which is added for purposes of providing additional weight at the head of the racquet, and to broaden the sweet spot on the racquet by having a little more weight at the perimeter portions, which does so by increasing rotational moment of inertia, which resists twisting. The material surrounding the lead 30—30 are polyaramid layers 32, such aramids include Kevlar 49, Kevlar 29, Nomex, all made by DuPont, but could include other equivalent materials, as will be more evident from the lay-up pattern of FIG. 6, the polyaramid layers are continuous about the perimeter of the frame and provide an internal cushioning core which is designed to absorb the shock impact onto the more brittle graphite. The basic graphite layer is illustrated by numeral 34, and this is surrounded by an additional graphite layer 36, and yet a further graphite layer 38, all of which will be more apparent in the overall lay-up schematic of FIG. 6. In effect, the different layers are characterized by different winding angles (to vary stiffness and strength). A fiber glass outer wrap at 40 is provided to cushion and provide shock absorbing protection to the graphite layers 34 through 38. The thin, softer urethane layer 42 is provided on the inside surface of the frame to protect the strings from wear and fraying.

FIG. 3 illustrates the cross-sectional cut taken at line 3—3 of FIG. 1 and it is seen that the lead, 30 is not present at this cut, and the large aramid core 32 is more readily present. FIG. 3 illustrates an additional graphite layer 44 which relationship again will be more readily apparent from the lay-up drawing of FIG. 6. FIG. 4 is taken on line 4—4 of FIG. 1 and shows all the same composite relationships except for the addition of a boron strengthening insert 46, this of course being present throughout the neck portion of the racquet to prevent fracture and failure in the neck portion as this is the portion taking the greatest flex and torsional forces during utilization of the racquet. The boron layer 46 is positioned on opposite sides of the frame 12 and in essence lying substantially parallel to the stringing, the transverse string indicated by the numeral 14.

Because of the brittle nature of graphite and boron, a successful racquet design must incorporate some means for absorbing shock impact which occurs normally during the course of play. Resistance to shattering is particularly needed in those racquets which are used in enclosures, such as racquetball and the like, because of the frequency with which the racquet actually hits the walls or the floor.

The instant invention provides for absorption of shock through the utilization of certain high strength, impact resistant materials. In this instance, the shock absorption is provided by the aramid layer 32 and the fiber glass reinforced wrapping over the boron and graphite.

Figure 5:
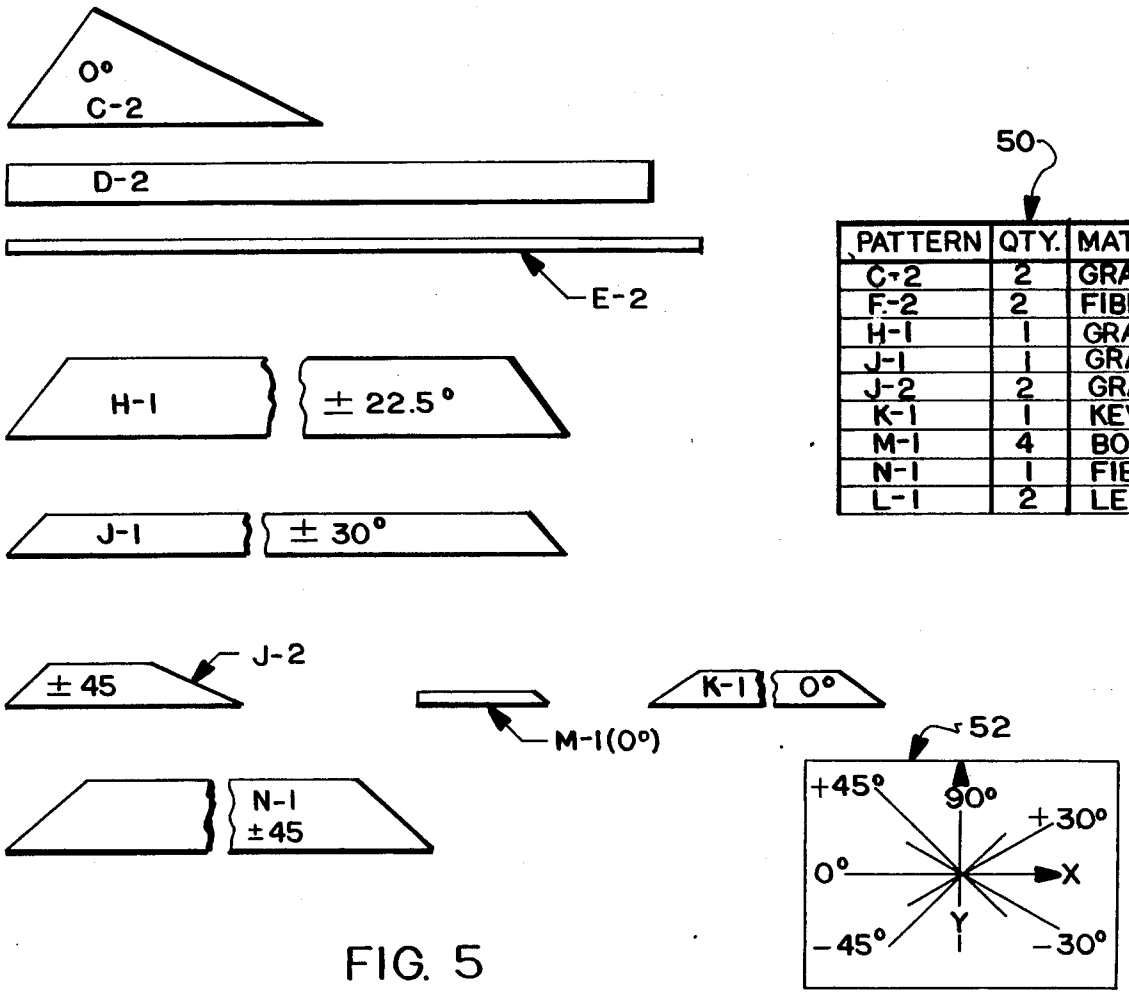
FIG. 5 is an illustration of the dimensional configuration in the preferred grain direction for the various components utilized to make up the composite racquet.

FIG. 5 illustrates the particular dimensional arrangement of the various composite layers in their flat, unrolled condition and the chart of numeral 50 illustrates the material comprising each individual layer, while the direction of grain chart of numeral 52 illustrates the angular relationship of the grain or the weave in each particular layer. Thus, for example, component N-1 is fiber glass, there is a single piece that is about 43 inches long, 3.5 inches wide, with a tapered end of 3 inches in length and the direction of the grain is plus or minus 45 degrees.

Figure 6:
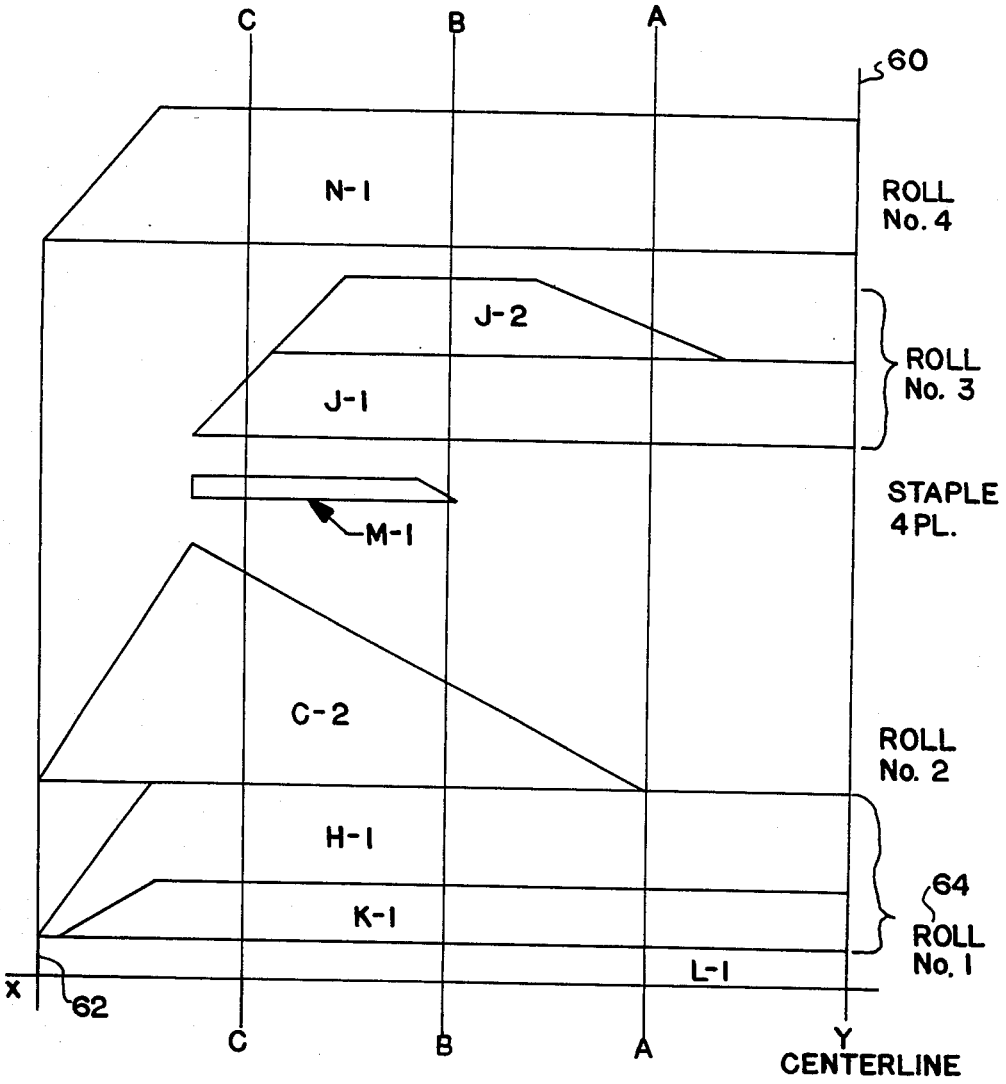
FIG. 6 is a lay-up pattern for rolling the composite materials onto a mandrel to assure the positioning and arrangement of the various components making up the composite racquet.

With the layout diagram of FIG. 5 in mind, the actual forming of the frame is illustrated in the lay-up drawing of FIG. 6. Essentially, it has been found convenient to utilize a small diameter mandrel with which to wrap the materials around to achieve the proper laid-up configuration, and then remove the mandrel and place the wrapped lay-up into a forming mold where heat and pressure can be applied to cure the composite lay-up.

Specifically, with reference to FIG. 6, this illustrates only one half of the length of the lay-up, or to the center line indicated by numeral 60 which is also illustrated on the perspective of FIG. 1, that being the head of the racquet and with the zero point at the left indicating the ends of the handle, at numeral 62.

The lay-up initially starts with a small piece of lead, L-1, which is positioned at about the 18.5 inch mark on the mandrel, this being about 2½ inches long as indicated and by referring to chart 50, it can be seen that each piece of lead tape weighs about 8.0 grams. Next, the K-1 layer is positioned on top of the H-1 layer and role No. 1 takes place as illustrated by numeral 64 which rolls the K-1 layer immediately adjacent to the mandrel and the H-1 layer over top of the K-1 layer. Next, the mandrel is positioned adjacent to the C-2 layer as shown and role 2 takes place which then wraps the C-2 layer around the combined wrapped K-1 and H-1 layers. At this point, the boron layer M-1 is stapled into position, this being two M-1 layers positioned on diametrically opposite sides of the mandrel so as to end up achieving the positional relationship shown in FIG. 4 of the drawings after the final mold.

Role 3 now takes place by positioning the J-1 layer and J-2 layer as illustrated and rolling, and the final composite roll takes place by rolling the N-1 layer onto the outside achieving the full and complete wrap and cushioning effect of this outer fiber glass layer.

It should also be noted in FIG. 6 that the positioning of the cuts 2—2, 3—3, and 4—4 are illustrated on this lay-up drawing so that it is possible to see where these take place in the actual roll-up and hence why the particular overall layer relationship of FIGS. 2, 3 and 4 is present. In this regard, it is to be clearly noted that the inside Kevlar layer K-1 extends the full length of the racquet and thus acts as a full internal shock absorber mechanism for the multiple graphite layers H-1, C-2, J-1 and J-2. It should be noted that H-1 extends also the whole length of the frame, whereas C-2, of course, extends only about 15 inches in the handle portion and actually provides the additional strengthening into the neck portion at the said basic relationship as the M-1 layer. It should also be noted that J-1 extends more up through the head portion of the racquet frame and not into the handle and J-2 is providing the stiffening in the side frame portions 70 as seen in FIG. 1 of the overall racquet frame.

The handle and grip portion can be completed in any convenient way as normally utilized in this type of racquet construction, although a foamed shock-absorbant material is preferred. It is preferable to include some type of outer bumper at 72 to protect both the frame itself as well as the string in that portion from the abuse the racquet takes when it hits the wall and/or the floor of the racquet court, also to mitigate the risk of injury to an opponent.

The graphite fiber layer provides the requisite stiffness to the racquet. Graphite fibers suitable for use in the invention are those having a tensile strength of about 200,000 psi. The modulus should be about $20\times10^6$. The strain ratio, that is $\sigma/E$ must equal 0.01 or greater. There currently are new graphite/epoxy materials becoming available which appear to have strain ratios of 0.015 to 0.017 and look very promising.

The boron layer comprises a material having about 400,000 psi tensile strength, 500,000 psi compressive strength, and about $30\times10^6$ psi tensile modulus.

The shape of the racquet is significant from the standpoint of utilizing a quadraform/wishbone shape which enables a longer stringing pattern and lighter weight than racquets with throat pieces. The lack of throat enables long main strings but requires strength and stiffness of graphite composite.

The properties of the aramids such as Kevlar 29, Kevlar 49 and Nomex by DuPont are well known based on specifications published by DuPont.

With the increased strength of this particular frame, it has been possible to utilize a stringing pattern, with the strings further apart both in the transverse and longitudinal direction, thus giving shear strings in contact with the ball, and therefor more control of the ball with the racquet as well as a greater and quicker response, thus providing more power from the same stroke. The sunburst stringing pattern is utilized as shown in Fig. 1 and it has been found that the number of longitudinal strings is 12 and the transverse strings 17 with the shortened string 22 at the top which seems to be needed to keep the longitudinal strings from working too much and fraying at the intersections with the transverse strings.

While in accordance with the patent statutes only the best known embodiment of the invention has been illustrated and described in detail, it is to be particularly understood that the invention is not limited thereto or thereby, but that the inventive scope is defined in the appended claims.

Further, it is to be understood that the basic structure of the invention is to utilize graphite in a shock absorber, mounted relationship with respect to the Kevlar and the fiber glass so as to achieve the greater stiffness of the graphite, while preventing it from fracturing or breaking because of shock loading through the racquet.

In this regard, various lay-up layers and the like might be utilized other than that shown in the lay-up of Fig. 6, and still achieve the objects of the invention. Likewise, the lead weight L-1 might not be utilized if it is decided that a lighter racquet head is desirable. By the same manner, the actual grain direction of the respective fibers might be varied to achieve slightly different torque, stiffness and strength characteristics in the frame itself.

What is claimed is:

1. A throatless and wishbone shaped graphite composite racquet frame having a head, a neck and a handle, said frame comprising:

a core of aramid;

a layer of graphite fibers surrounding said core; and a fiber glass wrapping positioned over said layer of graphite fiber, forming a composite thereby;

wherein the graphite fiber is cushioned by the aramid on the inside and the fiber glass wrap on the outside of the racquet frame, said core of aramid, said layer of graphite fibers, and fiber glass wrapping being continuous throughout the head, neck and handle portions of the frame;

and a pair of opposite boron inserts in the neck portion of the racquet, said inserts positioned on opposite sides of the frame substantially parallel to each other to achieve higher stiffness and strength in the neck region without added weight or bulk, said boron inserts being positioned over said graphite layer and under said fiber glass wrapping.

2. A racquet frame according to claim 1 which includes weighting means positioned in the frame at the head thereof to widen the sweet spot of the racquet.

3. A racquet frame according to claim 1 wherein the boron inserts have a tensile strength of about 400,000 psi, compressive strength of about 500,000 psi, and a tensile modulus of about $30\times10^6$ psi.

4. A racquet frame according to claim 1 wherein the graphite fibers have a tensile strength of about 200,000 psi and a modulus of about $20\times10^6$ psi, and having a strain ratio of 0.01 or greater.

5. A racquet frame according to claim 1 in which the direction of the grain of the graphite fibers in each layer is at an angle to the longitudinal axis of the frame.

6. a racquet frame according to claim 1 including an additional continuous graphite layer surrounding the first-mentions layer, said additional graphite layer extending through the head but not into the handle of said frame, said boron inserts being positioned between the first-mentioned and the additional graphite layers.

* * * * *